US011484931B2

(12) United States Patent
Lozano Bonet

(10) Patent No.: US 11,484,931 B2
(45) Date of Patent: Nov. 1, 2022

(54) FINE BLANKING PRESS AND METHOD FOR HANDLING A PROCESS MATERIAL TO BE PROCESSED IN A FINE BLANKING PRESS

(71) Applicant: Lapmaster Wolters GmbH, Rendsburg (DE)

(72) Inventor: Jose Lozano Bonet, Rendsburg (DE)

(73) Assignee: Lapmaster Wolters GmbH, Rendsberg (DE)

( * ) Notice: Subject to any disclaimer, the term of this patent is extended or adjusted under 35 U.S.C. 154(b) by 332 days.

(21) Appl. No.: 16/452,994

(22) Filed: Jun. 26, 2019

(65) Prior Publication Data

US 2020/0009633 A1 Jan. 9, 2020

(30) Foreign Application Priority Data

Jul. 9, 2018 (EP) ..... 18182386

(51) Int. Cl.
*B21D 28/16* (2006.01)
*B21D 43/28* (2006.01)

(52) U.S. Cl.
CPC ..... *B21D 28/16* (2013.01); *B21D 43/28* (2013.01); *Y10T 83/06* (2015.04); *Y10T 83/4539* (2015.04); *Y10T 83/6563* (2015.04)

(58) Field of Classification Search
CPC ..... Y10T 83/6659; Y10T 83/6572; Y10T 83/4561; Y10T 83/7493; Y10T 83/4714; Y10T 83/4717; B21D 1/02; B21D 1/00; B21D 43/28; B21D 43/00; B21D 43/02; B21D 43/09; B21D 43/287; B21D 43/08;
(Continued)

(56) References Cited

U.S. PATENT DOCUMENTS 4,462,521 A * 7/1984 Takagi ..... B21K 27/04 198/621.2
6,145,424 A * 11/2000 Matsuda ..... B21D 28/265 226/112

(Continued)

FOREIGN PATENT DOCUMENTS

CN 102554555 B 7/2012
CN 202952046 U 5/2013

(Continued)

OTHER PUBLICATIONS

CN-105013953-A English Translation; Nov. 2015 ; Jiang Haishe; B21D28/14.*

(Continued)

*Primary Examiner* — Laura M Lee
(74) *Attorney, Agent, or Firm* — Barclay Damon LLP

(57) ABSTRACT

A fine blanking press comprises a blanking ram and a counter unit positioned opposite the blanking ram. A press drive is configured to drive at least the blanking ram along a driving direction during a fine blanking process step. A feeding device is configured to feed a process material to a process zone defined between the blanking ram and the counter unit and at least one handling device is configured to handle the process material outside of the process zone. At least one levelling drive is configured to drive the at least one handling device in a same direction as the blanking ram during a fine blanking process step.

8 Claims, 3 Drawing Sheets

(58) Field of Classification Search
CPC ..... B21D 28/16; B21D 28/26; B21B 2015/0071; B23D 25/12
USPC ..... 72/160, 164, 165; 83/40, 50, 55, 306, 83/307, 405
See application file for complete search history.

(56) References Cited

U.S. PATENT DOCUMENTS

| | | | | |
|---|---|---|---|---|
| 8,333,093 | B2 * | 12/2012 | Kleckner | B21D 53/886 72/132 |
| 2002/0011395 | A1 * | 1/2002 | Luthi | B65G 25/02 198/339.1 |
| 2018/0369895 | A1 * | 12/2018 | Ishihara | B21D 43/06 |
| 2020/0009633 | A1 * | 1/2020 | Lozano Bonet | B21D 28/02 |
| 2020/0180252 | A1 * | 6/2020 | Sakurai | B30B 15/30 |
| 2020/0188983 | A1 * | 6/2020 | Lozano Bonet | B21D 28/34 |

FOREIGN PATENT DOCUMENTS

| | | | | |
|---|---|---|---|---|
| CN | 105013953 | A * | 11/2015 | B21D 28/14 |
| CN | 105013953 | A | 11/2015 | |
| CN | 105057385 | A | 11/2015 | |
| CN | 206770306 | U | 12/2017 | |
| EP | 2213601 | A1 | 8/2010 | |

OTHER PUBLICATIONS

CN 201910596963.5; filed Jan. 17, 2020; Office Action dated Jan. 26, 2022 (10 pages).
CN 201910596963.5; filed Jan. 17, 2020; English Translation of Office Action dated Jan. 26, 2022 (9 pages).

* cited by examiner

FINE BLANKING PRESS AND METHOD FOR HANDLING A PROCESS MATERIAL TO BE PROCESSED IN A FINE BLANKING PRESS

CROSS REFERENCE TO RELATED INVENTION

This application is based upon and claims priority to, under relevant sections of 35 U.S.C. § 119, European Patent Application No. 18 182 386.5, filed Jul. 9, 2018, the entire contents of which are hereby incorporated by reference.

BACKGROUND

Fine blanking presses allow blanking parts for example from sheet metal with high quality and flexibility with regard to the design of the parts. Fine blanking presses comprise a blanking ram and a counter unit, such as a working table, arranged opposite the blanking ram. A blanking tool is arranged between the blanking ram and the working table. The blanking tool can comprise for example one or more pressure plates or ejectors directly connected by transfer pins to the blanking ram cushion or the working table cushion, as well as one or more punches or dies. During a fine blanking process step the blanking ram is driven along a driving direction against the counter unit wherein sheet metal to be processed is held by the blanking tool between the blanking ram and the counter unit. For blanking a part out of the process material for example press punches of the blanking tool can move relative to the blanking ram and working table. Usually one of the cushions is provided with impingement means, for example an impingement ring, like a V-ring, for securely holding the process material in place during the blanking operation. The fine blanking process can also comprise progressive tooling process steps, wherein a part is blanked performing subsequent movements of blanking and counter units.

The sheet metal to be processed in the fine blanking press is usually present as a coil on a reel and is unwound and fed into the process zone between the blanking ram and the counter unit by a feeding device. Further handling devices can be present for handling the process material before entering the process zone and after leaving the process zone. Besides feeding devices such handling devices can comprise for example guiding devices for guiding the process material or chopping devices for chopping scrap material after leaving the process zone.

In known fine blanking presses movement of the blanking ram during the fine blanking process step leads to bending of the process material between the process zone and handling devices. This material flexion causes problems with regard to a precise feeding of the process material into the process zone (coil or strip pitch feeding problems). It also can lead to chipping damage on tool components, such as press punches. This is particularly problematic in progressive tooling. The explained flexion of the process material can also cause problems when opening the blanking press for ejection of the blanked parts. Flexion of the process material can also cause deformation on pierced holes, coinings and other geometries. This is especially critical in progressive tooling or transfer tooling because it generates poor part quality.

Based on the above explained prior art it is an object of the invention to provide a fine blanking press and method of the above explained type wherein problems associated with feeding the process material can be eliminated and quality of the produced parts can be improved.

BRIEF SUMMARY OF THE INVENTION

For a method of the above explained type the invention solves the object in that at least one handling device for handling the process material before entering the process zone and/or after leaving the process zone is driven in the same direction as the blanking ram during a fine blanking process step.

The invention pertains to a fine blanking press comprising a blanking ram and a counter unit arranged opposite the blanking ram and comprising a press drive for driving at least the blanking ram along a driving direction during a fine blanking process step, further comprising a feeding device for feeding a process material to be processed in the fine blanking press to a process zone between the blanking ram and the counter unit, and comprising at least one handling device for handling the process material before entering the process zone and/or after leaving the process zone.

The invention further pertains to a method for handling a process material to be processed in a fine blanking press, wherein the process material is fed to a process zone between a blanking ram and a counter unit arranged opposite the blanking ram, wherein at least the blanking ram is driven along a driving direction during a fine blanking process step. For a fine blanking press of the above explained type the invention solves the object in that the at least one handling device comprises at least one leveling drive designed to drive the at least one handling device in the same direction as the blanking ram during a fine blanking process step.

As explained above a fine blanking press comprises a blanking ram and a counter unit arranged opposite the blanking ram. The counter unit can for example be a working table. However, the counter unit could also be a counter ram for example. A blanking tool is arranged between the blanking ram and the counter unit. The blanking tool can comprise for example one or more pressure plates or ejectors directly connected by transfer pins to the blanking ram cushion or the working table cushion, as well as one or more punches or dies. A press drive drives at least the blanking ram along a driving direction during a fine blanking process step. The process material is clamped by means of the blanking tool between the blanking ram and the counter unit during the fine blanking process step. A feeding device feeds the material to be processed into the process zone between the blanking ram and the counter unit. The process material is typically sheet metal. It can be present as a coil that is unwound from a reel and fed flat to the process zone between the blanking ram and the counter unit by the feeding device. A counter unit drive can also be provided for exerting a holding force against the pressing force of the blanking ram so that the process material is securely clamped by means of the blanking tool between the blanking ram and the counter unit during a blanking process step. For blanking a part out of the process material for example press punches of the blanking tool can move relative to the blanking ram and working table. For example a pressure plate of the blanking tool can be provided with impingement means, for example an impingement ring, like a V-ring, for securely holding the process material in place and avoid material flow that could interfere with the quality of the blanked parts in regards to roll over amount during the blanking operation. Such an impingement ring can surround the part of the process material forming the future blanked part. The driving direction of the blanking ram is usually perpendicular to a feeding direction of the process material.

The fine blanking press further comprises one or more handling devices for handling the process material before entering the process zone and/or after leaving the process zone. According to the invention at least one leveling drive is provided which drives the at least one handling device in the same direction as the blanking ram during a fine blanking process step. The at least one handling device can be driven in the same direction as the blanking ram during the complete fine blanking process step or only temporarily during the fine blanking process step.

While in known fine blanking presses the process material is held in a fixed position perpendicular to the feeding direction of the process material, and thus inevitably bent when the blanking ram moves during a fine blanking process step, the invention is based on the idea of having the at least one handling device follow the movement of the blanking ram during the fine blanking process step. The process material is thus not positionally fixed in a direction perpendicular to the feeding direction, but rather is moved according to the movement of the blanking ram. Therefore, bending of the process material between the process zone, i.e. the blanking ram and the counter unit, and the at least one handling device can be substantially reduced or even fully eliminated. The above explained problems associated with such bending, i.e. problems related to the feeding of the process material or quality imperfections of the blanked parts, such as coil deformation that affects feeding accuracy, part defects, and reduced part accuracy, especially in complex progressive tooling, as well as tool damage, like tool component chipping, caused by process material bending, especially in the area surrounding the press punch, can be securely avoided according to the invention.

As explained the at least one leveling drive can make the at least one handling device follow the movement of the blanking ram during the entire fine blanking process step. The fine blanking process step can also include the opening of the blanking ram for ejection of the produced parts and the scrap process material. In this manner the tool opening process can be more reliably controlled based on the ram movement, and in addition based on movement of the at least one handling device effected by the at least one leveling drive.

As explained, the fine blanking process step can comprise every movement of the blanking ram, i.e. movement forward and backward along the driving direction, as well as the closing of the fine blanking press components before the blanking step and opening of the fine blanking press components after performing the blanking step, for ejection. Generally speaking, the fine blanking process step can comprise any movement of press components in a direction in particular perpendicular to the feeding direction of the process material. All such movements can lead to the above explained bending of the process material with the associated problems.

Generally, a multitude of embodiments of the fine blanking press are possible according to the invention. Of course also more than one blanking ram and/or counter unit can be provided. If the fine blanking press comprises several blanking rams, these can be provided with individual press drives or a common press drive. If the fine blanking press comprises several counter units, these can be provided with individual counter unit drives or a common counter unit drive or no counter unit drive at all. The fine blanking process step can comprise progressive tooling process steps, wherein the blanked part is produced by subsequently or simultaneously carrying out blanking ram movements along the driving direction.

The at least one handling device can comprise one or more of the group comprising a process material feeding device, a process material guiding device, a process material straightening device and a process material cutting device. The feeding device of the fine blanking press can thus constitute a handling device. The cutting device is provided after the process material leaves the process zone for cutting scrap process material after blanking has been performed. According to the invention, any combination of one or more of the explained handling devices can be provided.

According to a further embodiment the at least one leveling drive is designed to drive the at least one handling device such that the process material is not bent between the process zone and the at least one handling device during the fine blanking process step. This embodiment provides full advantage of the inventive teaching. In particular, bending of the process material between the process zone, i.e. between the blanking ram and the counter unit, and the at least one handling device is fully avoided. The above explained problems of known fine blanking presses are thus entirely eliminated.

The press drive can generally be any kind of suitable drive. For example the press drive can be a hydraulic drive or a mechanical drive or a servo-hydraulic drive or a servo-mechanical drive or an electrical drive or a pneumatic drive. Also the at least one leveling drive can be generally any drive suitable for the purpose. For example, the at least one leveling drive can be a hydraulic drive or a mechanical drive or a servo-hydraulic drive or a servo-mechanical drive or an electrical drive or a pneumatic drive. Any combinations of the above explained drive types are possible.

According to a further embodiment a synchronizer is provided for synchronizing the driving movement of the blanking ram with the driving movement of the at least one handling device. Such synchronized movement may in particular comprise synchronization of the movement speed as well as movement acceleration and deceleration. Generally speaking a completely synchronized movement of the press drive and the at least one leveling drive can be provided. According to this embodiment the handling device can completely follow the movement of the blanking ram during the fine blanking process step, i.e. perform the same movement directions, movement speeds and movement accelerations and decelerations. However, it is also possible that the handling device follows the movements of the blanking ram only partially, for example performs at least temporarily different movement speeds and/or accelerations and/or decelerations. As explained the handling device may also have different speed or acceleration than the blanking ram during at least a part of the driving movement of the blanking ram. It would also be possible that the handling device is only moved for a part of the total stroke of the blanking ram.

The synchronizer can further comprise a controller for providing a closed-loop controlled synchronizing of the press drive of the blanking ram with the at least one leveling drive of the at least one handling device. Such closed-loop control enhances synchronization, in particular if the blanking ram and the at least one handling device are driven by independent drives. The controller can comprise one or more sensors for detecting the position and/or the movement direction and/or the movement speed and/or acceleration and deceleration of the blanking ram and/or the at least one handling device.

According to a further embodiment the synchronizer can comprise at least one synchronizing controller, for example an electronic synchronizing controller, for synchronizing the press drive of the blanking ram with the at least one leveling drive of the at least one handling device. Such a controller can receive measuring data from the above explained sensors. On this basis it can control in particular individual drives of the blanking ram and the at least one handling device in a reliable and fast manner without delays caused for example by switching valves or the like. The inventive leveling can thus be effected through an independent axis management for the different drives. The controller can be a main controller that may be supported by secondary controllers, if needed, wherein such secondary controllers can for example control the individual drives. In this connection a complete closed-loop control is particularly advantageous to reliably control the independent movements of the blanking ram and the one or more handling devices.

According to a further embodiment a connecting means such as a connector can be provided for connecting the press drive with the at least one leveling drive, wherein the at least one leveling drive is partly or completely driven by the press drive. The connecting means may transmit energy generated during the movement of the rams to be used for driving the at least one handling device. This allows on the one hand a particularly energy efficient performance of the fine blanking press. On the other hand it also makes synchronization of the movement of the press drive and the leveling drive particularly easy. It would also be possible to provide energy storing means for storing energy generated by the movement of the blanking ram. Such stored energy could be used for further purposes in addition to driving the leveling drive, such as additional movements or energizing other peripheral components of the fine blanking press. The connecting means are particularly useful when the press drive and the at least one leveling drive are mechanical, servo-mechanical, hydraulic or servo-hydraulic drives or for example pneumatical drives. Of course, also a hybrid system is feasible using for example an electronic leveling system in combination with a mechanical, hydraulic or pneumatic connecting/energy transmitting system.

According to a further embodiment it is possible that the press drive is a hydraulic drive or a servo-hydraulic drive and the at least one levelling drive is a hydraulic drive or a servo-hydraulic drive, and in that the connecting means connect at least one hydraulic drive cylinder of the press drive with at least one hydraulic drive cylinder of the at least one levelling drive. It is further possible that the connecting means connect the at least one hydraulic drive cylinder of the press drive with the at least one hydraulic drive cylinder of the at least one levelling drive such that a movement of the at least one hydraulic drive cylinder of the press drive in a first direction results in a movement of the at least one hydraulic drive cylinder of the at least one levelling drive in the first direction, and a movement of the at least one hydraulic drive cylinder of the press drive in a second direction, opposite the first direction, results in a movement of the at least one hydraulic drive cylinder of the at least one levelling drive in the second direction. In an embodiment, the connecting means may comprise a connecting valve.

According to these embodiments movement of the at least one hydraulic drive cylinder of the press drive during ram movement also moves the at least one hydraulic drive cylinder of the at least one leveling drive. To this end the respective cylinders are connected through hydraulic pipes. This embodiment makes synchronization of the respective movement particularly easy. There are several ways to effect the connection between the hydraulic cylinders. In a simple version the connected hydraulic cylinders are based on equal active areas which makes controlling of the cylinders through displacement of oil between the cylinders particularly easy. However, also other embodiments are possible based on different active areas of the connected hydraulic cylinders, wherein however additional hydraulic equipment may be necessary to compensate flow differences of hydraulic fluid between the hydraulic cylinders. The equal active areas are present between the at least one hydraulic cylinder of the press drive on the one hand at the at least one hydraulic cylinder of the at least one leveling drive on the other side. If only one hydraulic cylinder is provided on each side, these hydraulic cylinders may thus have equal cylinder areas. If it is referred to equal areas in this respect, this refers to the overall active area of any hydraulic cylinders of the press drive on the one side and the overall active area of any hydraulic cylinders of the at least one leveling drive on the other side. Therefore, depending on the number ratios of cylinders provided on the one side and the other side the individual cylinders may have differing cylinder areas.

According to a further embodiment the volume of hydraulic fluid displaced by the at least one hydraulic cylinder of the press drive equals the volume of hydraulic fluid displaced by the at least one hydraulic cylinder of the at least one leveling drive, during the fine blanking process step. This can be achieved as explained above by providing equal areas of the cylinders on both sides of the connecting means. Of course, it would also be possible that the volume of hydraulic fluid displaced by the connected cylinders is not equal. In this case additional hydraulic components may be necessary. For example, a surplus of hydraulic fluid volume displaced by the at least one hydraulic cylinder of the press drive can be used for driving additional peripheral components of the fine blanking press, in addition to the hydraulic cylinders of the handling devices.

According to a further embodiment the at least one hydraulic cylinder of the press drive connected to the at least one hydraulic cylinder of the at least one leveling drive may be an auxiliary hydraulic cylinder driven by at least one main drive hydraulic cylinder driving the press drive. This further simplifies equaling the displaced volumes of hydraulic fluid. In particular if the main drive hydraulic cylinder displaces a very large volume of hydraulic fluid, which would be far too much volume than needed for the at least one handling drive, as would often be the case.

According to a further embodiment the connecting means further comprise a disconnecting valve for disconnecting the at least one hydraulic drive cylinder of the press drive from the at least one hydraulic drive cylinder of the at least one leveling drive. The disconnecting valve can for example bypass a connecting valve of the connecting means. With this embodiment it is possible to deactivate the inventive leveling system, which may be necessary in certain processes for example related to a specific tool design. The disconnecting valve disconnects the hydraulic pipes leading from the hydraulic cylinder of the press drive to the hydraulic cylinder of the handling device. For example the disconnecting valve can connect the two cylinder cavities of the at least one hydraulic cylinder of the press drive such that the hydraulic fluid is flushed from one to the other internal cavity of the at least one hydraulic cylinder of the press drive through the bypass valve without generation of any movement of the hydraulic cylinders of the at least one handling device.

The inventive method may be carried out using an inventive fine blanking press. Accordingly, the inventive fine blanking press may be designed to carry out the inventive method.

BRIEF DESCRIPTION OF THE DRAWINGS

Embodiments of the invention will be explained in more detail in the following by referring to drawings. In the drawings it is shown schematically.

In the drawings same reference numerals relate to identical or functionally identical components.

DETAILED DESCRIPTION OF THE INVENTION

Figure 1:
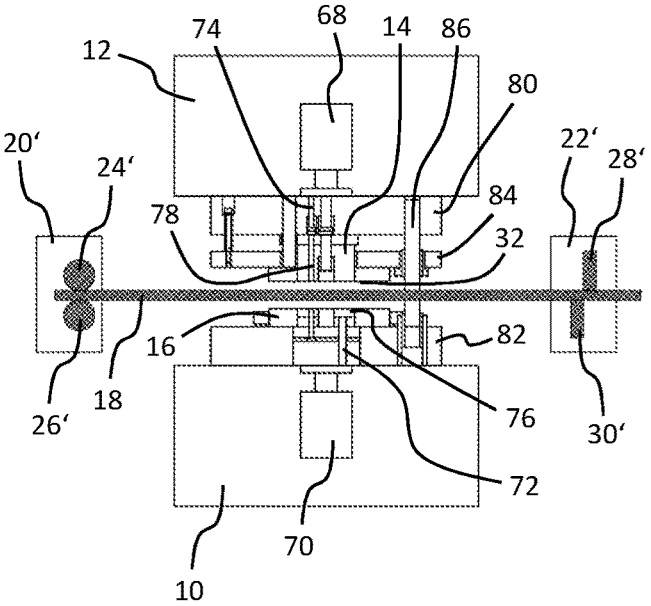
FIG. 1 illustrates a cross sectional view of an a fine blanking press in a first operating condition according to the prior art.
Figure 2:
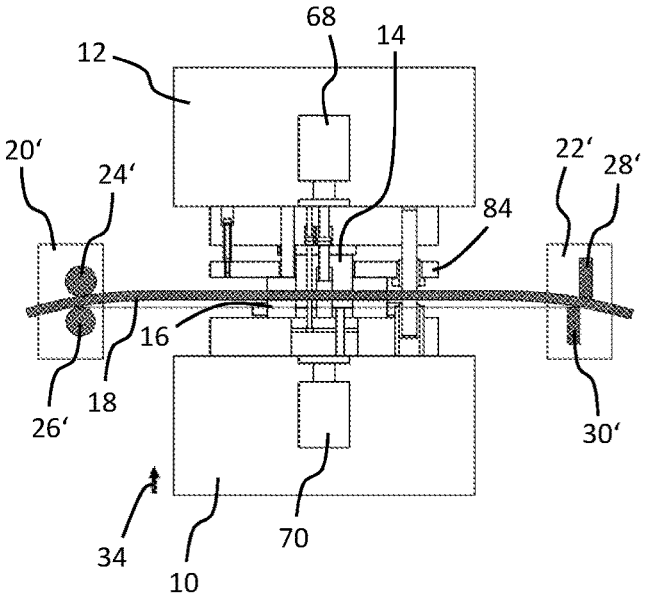
FIG. 2 illustrates the fine blanking press of FIG. 1 in a second operating condition.
Figure 3:
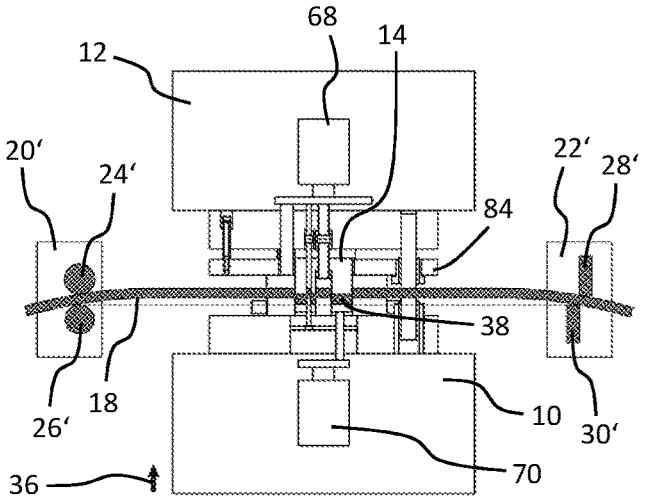
FIG. 3 illustrates the fine blanking press of FIG. 1 in a third operating condition.

The fine blanking press according to the prior art shown in FIGS. 1 to 3 comprises a blanking ram 10 and a counter unit 12 arranged opposite the blanking ram 10. In this example the counter unit 12 is a working table 12. A press drive not further shown in FIGS. 1 to 3 is provided for driving the blanking ram 10 along a driving direction, in FIGS. 1, 2 and 3 upwards and downwards, during a fine blanking process step. Integrated into the blanking ram 10 and the working table 12 are cushions 68, 70, which are connected to a blanking tool arranged between the blanking ram 10 and the working table 12 through transfer pins 72, 74. The blanking tool further comprises press punch 14, which may be positionally fixed together with the working table 12, and die 16, and moves together with the blanking ram 10. The blanking tool further comprises ejectors 76, 78, set plates 80, 82 pressure plate 84 and a tool guiding 86. Punch 14 and die 16 blank parts out of a sheet metal 18 fed to the process zone between the blanking ram 10 and the working table 12 by a feeding device 20', in the example shown in FIGS. 1 to 3 in a direction from left to right. A chopping device 22' is provided downstream of the process zone for chopping scrap process material after the fine blanking process. In the shown example the feeding device 20' comprises two rotationally driven feeding rollers 24', 26' arranged on opposite sides of the process material 18. Of course also other feeding devices are possible, for example gripper feeders or other feeders. The chopping device 22' comprises axially driven cutters 28', 30' arranged on opposite sides of the process material 18 for chopping the scrap process material. An impingement ring 32 is further shown schematically for securely holding the process material 18 during the fine blanking process. The impingement ring 32 may in particular be provided on the pressure plate 84 of the blanking tool driven by one of the cushions. This general design of a fine blanking press is known to the skilled person and shall not be explained in more detail.

FIG. 1 shows the open condition of the fine blanking press in which the process material 18 can be fed into the process zone. Subsequently, the blanking ram 10 is moved upwards against the working table 12, as shown by arrow 34 in FIG. 2.

The process material 18 is thus clamped by the blanking tool between the blanking ram 10 and the working table 12 and securely held in place by the impingement ring 32. Subsequently, the blanking ram 10 is further driven against the working table 12, as shown by arrow 36 in FIG. 3, punch 14 and die 16 thus blanking a part 38 out of the process material 18. The working table 12 may exert a counter force against the press drive of the blanking ram 10, for example through a cushion, in particular for clamping the impingement ring 32 into the process material 18 to improve clamping of the process material 18. After the explained movements the blanking ram 10 is moved downwards and the fine blanking press is opened again, as shown in FIG. 1, to eject the produced part 38.

As can be seen in FIGS. 2 and 3 the fixed position of the feeding device 20' and the chopping device 22' lead to severe bending of the process material 18 between the process zone and the handling devices.

Figure 4:
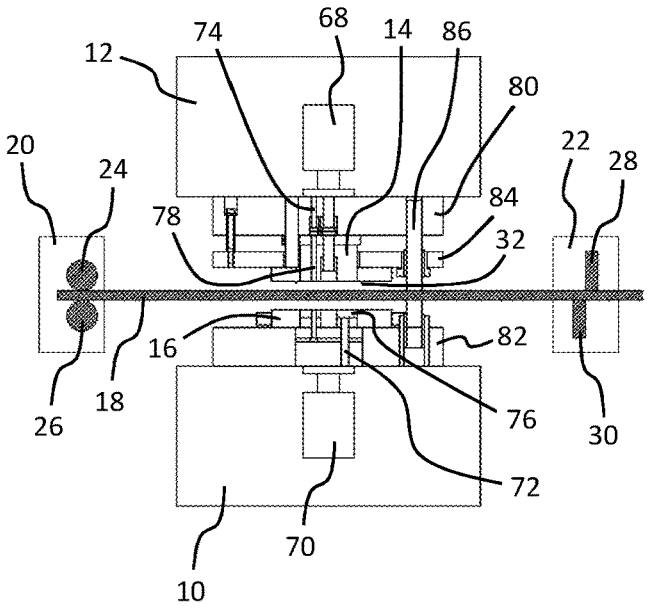
FIG. 4 illustrates a cross sectional view of an embodiment of a fine blanking press in a first operating condition.
Figure 5:
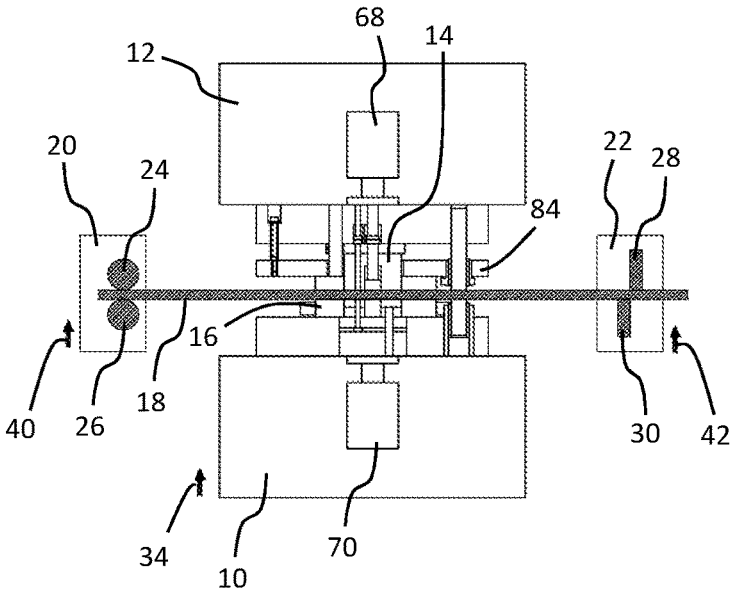
FIG. 5 illustrates the embodiment of the fine blanking press according to FIG. 4 in a second operating condition.
Figure 6:
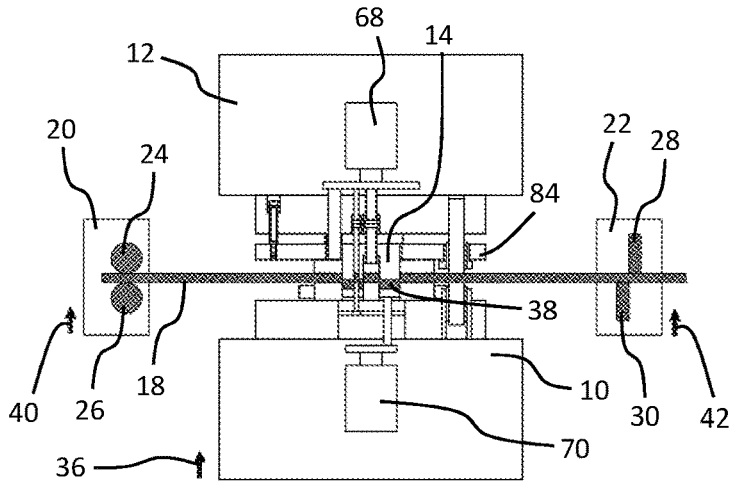
FIG. 6 illustrates the embodiment of the fine blanking press according to FIG. 4 in a third operating condition.

FIGS. 4 to 6 show an inventive embodiment of a fine blanking press. This fine blanking press corresponds largely to the fine blanking press as shown in FIGS. 1 to 3. It differs from the known fine blanking press shown in FIGS. 1 to 3 in the embodiment of the feeding device 20 with, in the shown example, its rotationally driven feeding rollers 24, 26 and the chopping device 22 with its axially driven cutters 28 and 30, as well as a connection between the press drive and the feeding device 20 and the chopping device 22, as will be explained in more detail in the following.

As can be seen in FIGS. 5 and 6, the feeding device 20 and the chopping device 22 are each provided with leveling drives that drive the feeding device 20 and the chopping device 22 synchronously in the same direction as the blanking ram 10 during the fine blanking process step. This includes in particular the operating conditions shown in FIGS. 4 to 6, and also subsequent operating conditions for moving the blanking ram 10 downwards and opening the fine blanking press for ejection of the blanked part 38. The movement of the feeding device 20 and the chopping device 22 is visualized by arrows 40, 42 in FIGS. 5 and 6. As can be seen from a comparison of FIGS. 4, 5 and 6, the process material 18 is not bent at any time during the fine blanking process between the process zone, provided between the blanking ram 10 and the working table 12, and the feeding device 20 on the one side and the chopping device 22 on the other side.

Figure 7:
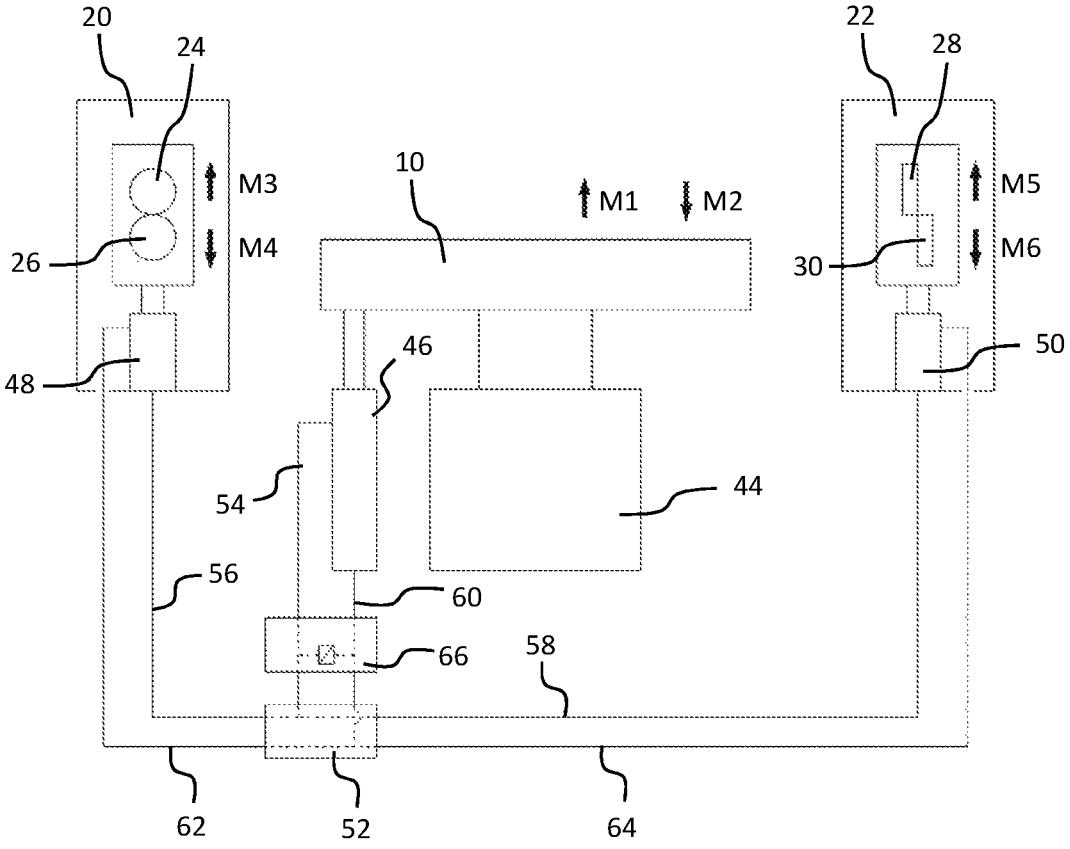
FIG. 7 illustrates a schematic diagram of an embodiment of a method for controlling of the fine blanking press.

FIG. 7 shows a block diagram visualizing an example of a possible embodiment for controlling the movement of the feeding device 20 and the chopping device 22. In FIG. 7 a main drive hydraulic cylinder 44 is shown as part of the press drive to drive blanking ram 10 along movement directions M1 and M2. Through this movement auxiliary hydraulic cylinder 46 is moved, which is also connected to the blanking ram 10. The feeding device 20 also comprises a hydraulic cylinder 48 as part of its leveling drive and the chopping device 22 comprises a hydraulic cylinder 50 as part of its leveling drive. A connecting valve 52 is provided connecting hydraulic line 54 with hydraulic lines 56 and 58 as well as hydraulic line 60 with hydraulic lines 62 and 64. Hydraulic line 54 is connected for example to the piston side of auxiliary hydraulic cylinder 46 and the barrel sides of hydraulic cylinders 48 and 50, and hydraulic line 60 is connected for example to the barrel side of auxiliary hydraulic cylinder 46 and the piston sides of hydraulic cylinders 48 and 50 through the connecting valve 52. In the shown example the active cylinder area of auxiliary hydraulic cylinder 46 is identical to the combined active cylinder areas of hydraulic cylinders 48, 50. In this manner movement of the blanking ram 10 effects movement of auxiliary hydraulic cylinder 46, which causes synchronized corresponding movement of hydraulic cylinders 48 and 50, and thus synchronized movement of feeding device 20 and chopping device 22. More specifically, movement of blanking ram 10 along direction M1 leads to a corresponding synchronized movement along directions M3 and M5 of feeding device 20 and chopping device 22, respectively. In the same manner, movement of blanking ram 10 along direction M2 leads to corresponding synchronized movement of feeding device 20 and chopping device 22 along directions M4 and M6, respectively. This synchronization encompasses movement direction, movement speed, as well as movement acceleration and deceleration.

A disconnecting valve 66 is further provided in the example, which when activated bypasses connecting valve 52 to flush hydraulic fluid between hydraulic lines 54 and 60, and thus between the piston side and the barrel side of auxiliary hydraulic cylinder 46 during movement of blanking ram 10. In this way, the leveling of feeding device 20 and chopping device 22 can be fully deactivated, if needed.

Of course, the drawings only show an exemplary embodiment of the invention. Other embodiments are possible. For example, more or less handling devices may be present. Also, control of the leveling drives could be different. For example, an electronic controller could be provided, as explained above, in particular if the leveling drives of the feeding device 20 and the chopping device 22 operate independently from the press drive of the blanking ram 10. Also, the controller could be provided for carrying out a closed-loop control of the movement of the different components of the fine blanking press. To this end, sensors could be provided for detecting position, movement direction, movement speed, acceleration and deceleration of different components of the fine blanking press, for example the blanking ram 10 and/or handling devices, such as the feeding device 20 and the chopping device 22. Also, it would be possible to move only a part of the handling devices, such as rollers 24 and 26, and cutters 28 and 30 to obtain the same advantage of a fully plain and parallel process material 18. Furthermore, as already explained, additional handing devices could be provided. Such additional handling devices could for example comprise a further guiding device downstream of the process zone in order to pull the process material out of the process zone. Any such further handling devices can be provided with leveling drives as explained above in order to synchronize speed and stroke of these handling devices with speed and stroke of the blanking ram 10.

Also, in certain embodiments, when switching off of the leveling system is not required, the disconnecting valve 66 could be omitted. Also, by using an appropriate T junction it would be possible to omit connecting valve 52. This would be possible in particular for example if the active cylinder area of hydraulic cylinders 48 and 50 is identical and each one half of the active cylinder area of auxiliary hydraulic cylinder 46. An additional accumulator or valve could be installed to refill the leveling system with the required amount of hydraulic fluid to compensate possible leakages during the ram stroke.

In some particular applications an unsynchronized system could be required to provide different movement speeds for the handling devices 20, 22 than for the ram 10 or for example only a following of the movement of the ram 10 for a part of the ram stroke. For example for effecting a partial following the disconnecting valve 66 could be activated at a certain time of the ram stroke to stop synchronization. For different movement speeds the connecting valve 52 could for example be a controllable valve which allows varying the volume of hydraulic fluid passed to the hydraulic cylinders 48 and 50. Different movement speeds could also be effected by providing different cylinder areas for hydraulic cylinders 48, 50 on the one hand and auxiliary hydraulic cylinder 46 on the other hand.

REFERENCE NUMERAL LIST

10 blanking ram
12 counter unit/working table
14 punch
16 die
18 process material
20 feeding device
20' feeding device
22 chopping device
22' chopping device
24 feeding roller
24' feeding roller
26 feeding roller
26' feeding roller
28 cutter
28' cutter
30 cutter
30' cutter
32 impingement ring
34 arrow
36 arrow
38 part
40 arrow
42 arrow
44 main drive hydraulic cylinder
46 auxiliary hydraulic cylinder
48 hydraulic cylinder
50 hydraulic cylinder
52 connecting valve
54 hydraulic line
56 hydraulic line
58 hydraulic line
60 hydraulic line
62 hydraulic line
64 hydraulic line
66 disconnecting valve
68 cushion
70 cushion
72 transfer pin
74 transfer pin
76 ejector
78 ejector
80 set plate
82 set plate
84 pressure plate
86 tool guiding

The invention claimed is:

1. A fine blanking press comprising:

a blanking ram;

a counter unit positioned opposite the blanking ram;

a press drive configured to drive at least the blanking ram along a driving direction during a fine blanking process step;

a feeding device configured to feed a process material to a process zone defined between the blanking ram and the counter unit;

at least one handling device configured to handle the process material outside of the process zone;

at least one levelling drive configured to drive the at least one handling device in a same direction as the blanking ram during a fine blanking process step such that the at least one handling device follows a driving movement of the blanking ram during the fine blanking process step so as to prevent bending of the process material between the process zone and the at least one handling device during the fine blanking process step;

a synchronizer configured for synchronizing the driving movement of the blanking ram with a driving movement of the at least one handling device, wherein synchronizer comprises a controller configured to provide a closed loop controlled synchronizing of the press drive with the at least one levelling drive; and a connector configured to connect the press drive with the at least one levelling drive, wherein the at least one levelling drive is partly or completely driven by the press drive, wherein the press drive is one of a hydraulic drive and a servo-hydraulic drive, wherein the at least one levelling drive is one of a hydraulic drive and a servo-hydraulic drive, and wherein the connector is configured to connect at least one hydraulic drive cylinder of the press drive with at least one hydraulic drive cylinder of the at least one levelling drive.

2. The fine blanking press according to claim 1, wherein the at least one handling device comprises one of a process material feeding device, a process material guiding device, a process material straightening device, and a process material cutting device.

3. The fine blanking press according to claim 1, wherein the press drive is one of a hydraulic drive, a mechanical drive, a servo-hydraulic drive, a servo-mechanical drive, an electrical drive, and a pneumatic drive.

4. The fine blanking press according to claim 1, wherein the at least one levelling drive is one of a hydraulic drive, a mechanical drive, a servo-hydraulic drive, a servo-mechanical drive, an electrical drive, and a pneumatic drive.

5. The fine blanking press according to claim 1, wherein the connector is configured to connect the at least one hydraulic drive cylinder of the press drive with the at least one hydraulic drive cylinder of the at least one levelling drive such that a movement of the at least one hydraulic drive cylinder of the press drive in a first direction results in a movement of the at least one hydraulic drive cylinder of the at least one levelling drive in the first direction, and wherein a movement of the at least one hydraulic drive cylinder of the press drive in a second direction opposite the first direction results in a movement of the at least one hydraulic drive cylinder of the at least one levelling drive in the second direction.

6. The fine blanking press according to claim 1, wherein a volume of hydraulic fluid displaced by the at least one hydraulic cylinder of the press drive equals a volume of hydraulic fluid displaced by the at least one hydraulic cylinder of the at least one levelling drive.

7. The fine blanking press according to claim 6, wherein the at least one hydraulic cylinder of the press drive connected to the at least one hydraulic cylinder of the at least one levelling drive is an auxiliary hydraulic cylinder driven by at least one main drive hydraulic cylinder driving the press drive.

8. The fine blanking press according to claim 7, wherein the connector comprises a disconnecting valve configured to disconnect the at least one hydraulic drive cylinder of the press drive from the at least one hydraulic drive cylinder of the at least one levelling drive.

* * * * *